United States Patent [19]

Ikeda

[11] Patent Number: 4,525,084

[45] Date of Patent: Jun. 25, 1985

[54] DEVICE FOR ADJUSTING POSITION OF PRINTING HEAD OF PRINTER

[75] Inventor: Yoshiaki Ikeda, Tokyo, Japan

[73] Assignee: Seikosha Co., Ltd., Tokyo, Japan

[21] Appl. No.: 554,353

[22] Filed: Nov. 22, 1983

[30] Foreign Application Priority Data

Nov. 29, 1982 [JP] Japan ..... 57-180386

[51] Int. Cl.[3] ..... B41J 11/20; B41J 11/22

[52] U.S. Cl. ..... 400/55; 400/59; 400/125; 400/157.1; 101/93.09; 101/93.16; 101/93.29; 101/93.48; 101/100

[58] Field of Search ..... 400/157.1, 125, 55, 400/56, 57, 59; 101/93.09, 93.15, 93.16, 93.17, 93.21, 93.28, 93.29, 93.48, 96, 100, 109, 111; 267/158, 163, 164

[56] References Cited

U.S. PATENT DOCUMENTS

| | | | |
|---|---|---|---|
| 1,440,905 | 1/1923 | Boenning | 267/158 |
| 1,904,681 | 4/1933 | Frantz | 267/158 |
| 2,354,834 | 8/1944 | Robey | 267/165 |
| 2,376,026 | 5/1945 | Bennett | 267/158 |
| 3,191,334 | 6/1965 | Jarvis et al. | 267/163 |
| 4,275,613 | 6/1981 | Wörner et al. | 267/158 |
| 4,390,292 | 6/1983 | Krenz | 400/59 |

FOREIGN PATENT DOCUMENTS

| | | |
|---|---|---|
| 50-149417 | 11/1975 | Japan . |
| 58-042122 | 9/1983 | Japan . |

*Primary Examiner*—Clyde I. Coughenour
*Assistant Examiner*—William L. Klima
*Attorney, Agent, or Firm*—Robert E. Burns; Emmanuel J. Lobato; Bruce L. Adams

[57] ABSTRACT

A device for adjusting the position of the printing head of a printer has a leaf spring received in a groove formed in the carrier of the printer. The spring is bent into a doglegged form such that the spring force is applied to both ends of the carrier backwardly. The printing head is mounted on a support plate which is provided with a groove with which the anchoring portions of the leaf spring engage. The support plate is mounted on the upper surface of the carrier so as to be slidable forwards and backwards by a counter-sunk screw.

13 Claims, 4 Drawing Figures

DEVICE FOR ADJUSTING POSITION OF PRINTING HEAD OF PRINTER

FIELD OF THE INVENTION

The present invention relates to a device for adjusting the position of the printing head of a printer.

BACKGROUND OF THE INVENTION

Conventionally, the printing heads of printers have been precisely positioned after adjusting the position thereof because good-quality printing characters cannot be obtained unless the distance between the printing hammer and the platen, which are on opposite sides of an ink ribbon and a sheet of printing paper is accurately established. For this purpose, a coiled spring for biasing the printing head rearwards is connected between the printing head and the carrier. Further, the printing head is arranged to be shiftable forwards step by step against the action of the coiled spring by the use of a counter-sunk screw or eccentric cam and then the head is held stationary in position. Therefore, a large space is required to install the coiled spring, and the structure of the device is complex.

SUMMARY OF THE INVENTION

Accordingly, it is the main object of the present invention to provide a device which acts to adjust the position of the printing head of a printer, and which is compact and simple in structure and is economical to fabricate.

This object is achieved, in accordance with the present invention, by providing a leaf spring to bias the printing head backwards.

Other objects and features of the invention will appear in the course of the description of the invention which is taken in conjunction with the accompanying drawings.

DETAILED DESCRIPTION OF THE INVENTION

Figure 1:
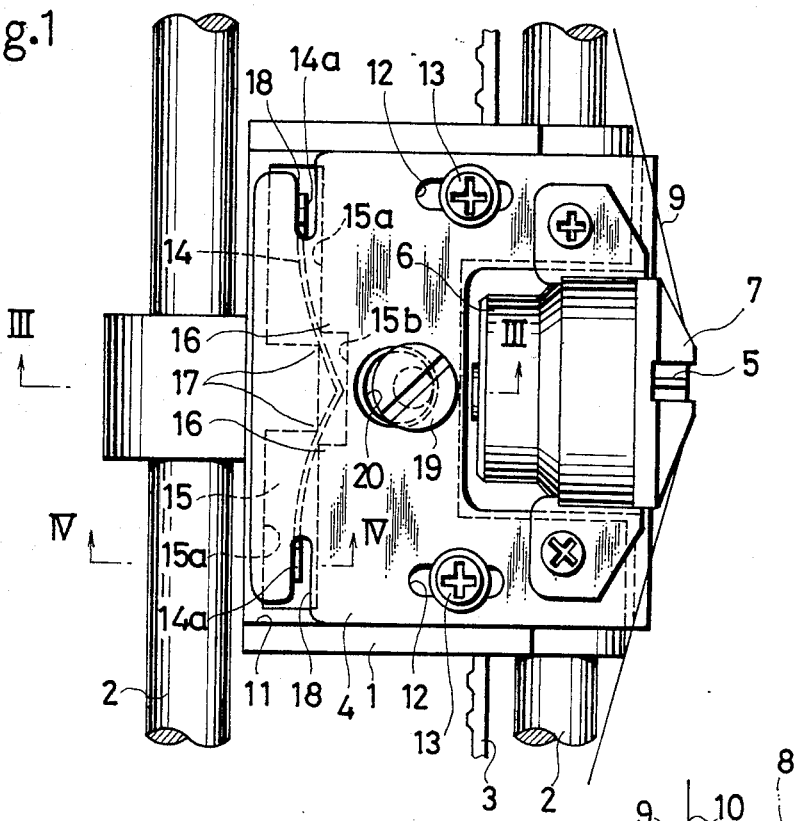
FIG. 1 is a plan view of a device according to the present invention.

Referring to the drawings, a printer has a carrier 1 which is supported so as to be movable along a pair of guide poles 2. The carrier is driven by means of a timing belt 3 securely fixed to the carrier 1. A printing head consisting of a printing hammer 5 and a device 6 for driving the hammer is firmly secured to a printing head support plate 4, which is in contact with the upper surface of the carrier 1. A ribbon guide 7 is also firmly secured to the support plate 4. A rotatable platen 8 is disposed opposite to the printing hammer 5, thereby leaving a space between them. An ink ribbon 9 and a sheet of printing paper 10 can pass through this space. The support plate 4 is connected to the carrier 1 so as to be movable forwards and backwards (in the rightward and leftward directions in FIGS. 1 and 2). As a specific example, a shallow guide groove 11 is formed in the upper surface of the carrier 1 so that the support plate 4 may be slidably fitted in the groove 11. The plate 4 is provided with a pair of elongate guide apertures 12 extending in such a direction that the plate 4 can slide towards and away from the platen 8, and a pair of set screws 13 pass through the apertures 12 and are screwed to the carrier 1.

Figure 2:
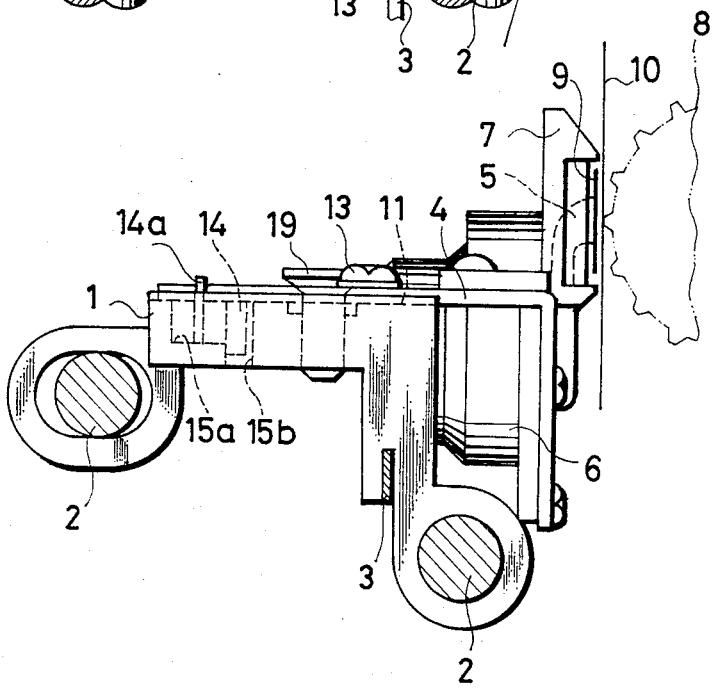
FIG. 2 is a side elevation of the device of FIG. 1.

A structure for applying a spring biasing force to the support plate 4 to move the plate 4 backwards relative to the carrier 1 will now described. A thin leaf spring 14 is formed into a doglegged shape having a pair of diverging arm portions diverging outwardly from a center portion and is provided with tabs 14*a* at both ends. The carrier 1 is formed with a recess 15 in which the leaf spring 14 is received in such a way that the spring 14 is bent into a doglegged form. As best shown in FIG. 1, the leaf spring 14 has a generally flattened or compressed V shape with the tip of the V comprising the spring center portion and the two legs of the V comprising the spring two arm portions.

Figure 3:
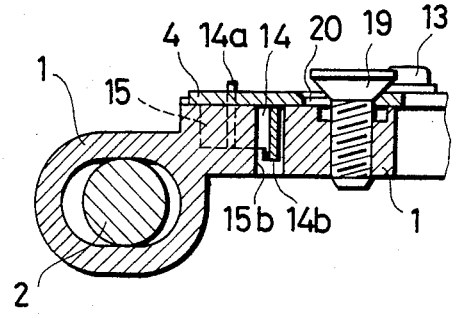
FIG 3 is a cross-sectional view taken on the line III—III of FIG. 1.
Figure 4:
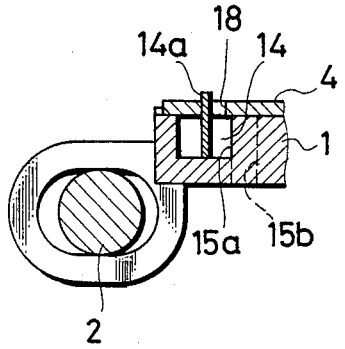
FIG. 4 is a cross-sectional view taken on the line IV—IV of FIG. 1.

As shown in FIG. 3, the center portion of the spring 14 is received in a hole 15*b* of the recess 15. The spring 14 has a locating protrusion 14*b*, which extends downwards from the center of the spring into the hole 15*b*. As shown in FIG. 1, the recess 15 for receiving the leaf spring 14 has opposed portions 15*a* on opposite ends of the hole 15*b*, these recess portions being in communication with the hole 15*b* at their adjoining ends 16,17. As can be seen from FIGS. 1 and 4, the support plate 4 is provided with slots 18 which are disposed opposite to the recess portions 15*a*. The aforementioned tabs 14*a* engage with the respective slots 18 which are narrower than the recess portions 15*a*. Therefore, the tabs 14*a* resiliently bias the support plate 4 backwardly away from the platen 8. It is to be noted that the structure for applying the spring force to the support plate is not limited to the above example. For example, similar utility may be obtained by inserting a doglegged leaf spring in a doglegged recess whose curvature is smaller than that of the spring. That is, the spring is urged to open against its resilience and then inserted into the recess 15 to engage the tabs 14*a* with the slots 18 of the plate 4.

The printing head support plate 4 to which the backward spring force is applied as described above is held such that its stationary position is adjustable forwards and backwards. In particular, as shown in FIGS. 1 and 3, a counter-sunk screw 19 having a tapered head is screwed into the carrier 1 and extends out through a hole 20 formed in the support plate 4. The front, inclined or tapered surface of the screw 19 restricts the backward position of the support plate 4 which is urged backwards, and therefore by screwing the screw deeper the backward position of the support plate 4 can be adjustably set. For example, by screwing the screw 19 inwardly, the support plate 4 is caused to slide forwards. The set screws 13 are tightened when the space between the printing hammer 5 and the platen 8 is set to a desired value, whereby the space is maintained. It should be understood that the means for adjusting the position of the support plate 4 forwardly and backwardly is not limited to the above example. For instance, an eccentric cam may be disposed upright on the carrier rotatably and inserted into the hole in the printing head support plate, with similar utility.

In assembling the present device, the leaf spring 14 is first located in the recess 15 in the carrier 1. Then, the support plate 4 on which the printing head is mounted is placed above the guide groove 11 while the tabs 14*a* of the spring 14 are brought into engagement with the slots 18. Subsequently, the set screws 14 are screwed slightly, and the counter-sunk screw 19 is screwed into the carrier. At the same time, the support plate 4 is advanced against the resilience of the spring 14 to adjust the space between the printing hammer 5 and the platen 8. When a predetermined space is attained, the set screws 13 are fully screwed into the carrier to fix the assembly, thus completing the assembling operation.

As described thus far, in accordance with the present invention, in order to exert the spring force on the printing head support plate backwardly, the leaf spring is received in the recess formed in the upper surface of the carrier, and the support plate is biased by tabs of both ends of the leaf spring. Hence, the device is compact, simple in structure, and requires only a small space to install. Further, it is economical to fabricate. Furthermore, the adjustment of position is quite easy.

Obviously many modifications and variations of the present invention are possible in the light of the above teachings. It is therefore to be understood that within the scope of the appended claims the invention may be practiced otherwise than as specifically described and shown.

What is claimed is:

1. A device for adjusting the position of a printing head of a printer comprising: a movable carrier having an upper surface provided with a recess; a support plate of the printing head slidably mounted on the carrier upper surface for slidable movement in forward and backward directions, the support plate covering the top opening of said recess; a leaf spring disposed within said recess and having at opposite ends thereof tabs integrally projecting upwards, said tabs being in engagement with said support plate to resiliently bias said support plate in the backward direction; and means for adjustably positioning said support plate on said carrier.

2. A device for adjusting the position of a printing head of a printer as set forth in claim 1; wherein said means for adjustably positioning said support plate comprises a counter-sunk head screw which passes through a hole of said support plate and which is screwed into said carrier.

3. A device for adjusting the position of a printing head of a printer as set forth in claim 1, wherein said means for adjustably positioning said support plate comprises an eccentric cam which passes through a hole of said support plate and which is rotatably mounted on said carrier.

4. A device for adjusting the position of a printer print head comprising: a movable carrier mountable for reciprocal movement on a printer during use of the device, the carrier having front and back portions and an elongate recessed portion; a support plate slidably disposed on the carrier for frontward and backward sliding movement relative to the carrier, the support plate having means for mounting a print head; biasing means for resiliently biasing the support plate backwardly, the biasing means comprising an elongate spring member disposed lengthwise within the carrier recessed portion and having a bent center portion and two diverging arm portions diverging outwardly from the center portion, the two arm portions engaging with the support plate to thereby resiliently bias the support plate backwardly; and means for adjustably setting the stationary position of the support plate on the carrier to thereby adjustably set the position of the print head.

5. A device according to claim 4; wherein the two arm portions of the spring member each have a projecting tab which engages with the support plate.

6. A device according to claim 5; wherein the support plate has two spaced apart openings in which extend the respective projecting tabs.

7. A device according to claim 4; wherein the spring member comprises a leaf spring having a generally flattened V shape with the tip of the V comprising the spring member bent center portion and the legs of the V comprising the spring member arm portions.

8. A device according to claim 7; wherein the carrier recessed portion has a hole therein; and the leaf spring has a protrusion at the center portion thereof extending into the hole to position the leaf spring within the carrier recessed portion.

9. A device according to claim 7; wherein the two arm portions of the leaf spring each have at their free end a projecting tab which engages with the support plate.

10. A device according to claim 7; wherein the means for adjustably setting the stationary position of the support plate comprises a hole extending through the support plate, and an axially tapered member inserted into the hole in contacting relation with the support plate and axially adjustably connected to the carrier so that axial adjustment of the tapered member effects frontward or backward sliding movement of the support plate.

11. A device according to claim 10; wherein the tapered member comprises a counter-sunk head screw threadedly connected to the carrier.

12. A device according to claim 4; wherein the means for adjustably setting the stationary position of the support plate comprises a hole extending through the support plate, and an axially tapered member inserted into the hole in contacting relation with the support plate and axially adjustably connected to the carrier so that axial adjustment of the tapered member effects frontward or backward sliding movement of the support plate.

13. A device according to claim 12; wherein the tapered member comprises a counter-sunk head screw threadedly connected to the carrier.

* * * * *